US010244302B2

(12) United States Patent
Zhao et al.

(10) Patent No.: US 10,244,302 B2
(45) Date of Patent: Mar. 26, 2019

(54) EARPHONE

(71) Applicant: GOERTEK INC., WeiFang (CN)

(72) Inventors: Yanpeng Zhao, Shandong (CN); Ping Xie, Shandong (CN); Xiaofei Fang, Shandong (CN)

(73) Assignee: GOERTEK INC., WeiFang (CN)

( * ) Notice: Subject to any disclaimer, the term of this patent is extended or adjusted under 35 U.S.C. 154(b) by 0 days.

(21) Appl. No.: 15/746,393

(22) PCT Filed: Jul. 19, 2016

(86) PCT No.: PCT/CN2016/090428
§ 371 (c)(1),
(2) Date: Jan. 19, 2018

(87) PCT Pub. No.: WO2017/012530
PCT Pub. Date: Jan. 26, 2017

(65) Prior Publication Data

US 2018/0199129 A1 Jul. 12, 2018

(30) Foreign Application Priority Data

Jul. 22, 2015 (CN) ..... 2015 1 0434768

(51) Int. Cl.
*H04R 1/10* (2006.01)
*H04R 9/02* (2006.01)
(Continued)

(52) U.S. Cl.
CPC ..... *H04R 1/1041* (2013.01); *H04R 1/2849* (2013.01); *H04R 9/025* (2013.01);
(Continued)

(58) Field of Classification Search
CPC ..... H04R 1/1041; H04R 1/10; H04R 1/1016; H04R 1/1075; H04R 9/025; H04R 9/06
See application file for complete search history.

(56) References Cited

U.S. PATENT DOCUMENTS 6,826,287 B2 * 11/2004 Myers ..... A61F 11/14 381/370
8,107,663 B2 * 1/2012 Lin ..... H04R 1/1041 181/133

(Continued)

FOREIGN PATENT DOCUMENTS

CN 104023292 A 9/2014
CN 104066024 A 9/2014

(Continued)

OTHER PUBLICATIONS

International Search Report for PCT/CN2016/090428 filed on Jul. 19, 2016.

(Continued)

*Primary Examiner* — Joshua Kaufman

(57) ABSTRACT

An earphone, comprising an earphone housing and a loudspeaker unit accommodated in the earphone housing, the loudspeaker unit dividing a cavity formed by the earphone housing into an earphone front sound cavity and an earphone rear sound cavity; wherein the earphone further comprises a tuning mechanism; wherein a rear sound cavity audio hole is provided on the loudspeaker unit rear sound cavity, and the loudspeaker unit rear sound cavity is in communication with the earphone rear sound cavity through the rear sound cavity audio hole; the tuning mechanism is provided between the rear sound cavity audio hole and the housing, and the tuning mechanism is used to adjust the size of the rear sound cavity audio hole of the loudspeaker unit. The present application allows for individual adjustment of the sound quality of the earphone in accordance with a middle and low frequency requirements of different users.

8 Claims, 3 Drawing Sheets

(51) Int. Cl.
*H04R 9/06* (2006.01)
*H04R 1/28* (2006.01)

(52) U.S. Cl.
CPC ..... *H04R 9/06* (2013.01); *H04R 1/1016* (2013.01); *H04R 1/1075* (2013.01); *H04R 1/2842* (2013.01)

(56) References Cited

U.S. PATENT DOCUMENTS 8,515,116 B2 * 8/2013 Lee ..... H04R 1/1041 381/338
8,831,266 B1 * 9/2014 Huang ..... H04R 1/1091 381/380
8,837,765 B2 9/2014 Lin
2008/0013773 A1 * 1/2008 Yang ..... H04R 1/2826 381/379
2012/0114160 A1 * 5/2012 Lin ..... H04R 1/1091 381/380
2013/0077800 A1 * 3/2013 Pan ..... H04R 1/2811 381/74
2013/0136290 A1 * 5/2013 Huang ..... H04R 1/1016 381/345
2013/0259287 A1 * 10/2013 Tseng ..... H04R 1/1016 381/380
2014/0226847 A1 * 8/2014 Yang ..... H04R 1/1075 381/380
2014/0286521 A1 * 9/2014 Yang ..... H04R 1/1041 381/380
2015/0237436 A1 * 8/2015 Wang ..... H04R 1/1041 381/380
2018/0199129 A1 * 7/2018 Zhao ..... H04R 1/1041
2018/0221207 A1 * 8/2018 Cobabe ..... H04R 1/1016

FOREIGN PATENT DOCUMENTS

CN 104735569 A 6/2015
CN 105187996 A 12/2015
CN 204968061 U 1/2016

OTHER PUBLICATIONS

Office Action from Chinese Patent Office for Application No. 201510434768.4, dated Mar. 2, 2018.

* cited by examiner

EARPHONE

CROSS-REFERENCE TO RELATED APPLICATIONS

The present specification is a U.S. National Stage of International Patent Application No. PCT/CN2016/090428 filed Jul. 19, 2016, which claims priority to and the benefit of Chinese Patent Application No. 201510434768.4 filed in the Chinese Intellectual Property Office on Jul. 22, 2015, the entire contents of which are incorporated herein by reference.

TECHNICAL FIELD

The present application relates to a field of acoustic technology, and more particularly to an earphone.

BACKGROUND ART

With the widespread use of portable electronics such as high-quality smart phones, Pads and the like, the requirements on the earphones that can be matching with the portable electronics are increasingly higher, the requirements comprise a compact size, and also a Hi-Fi sound quality performance for realistically reproducing a variety of sound effects. In addition, the earphone has become an essential accessory for various electronics in order to enable users to listen to the sound signals provided by electronics without disturbing other peoples, regardless the types of the electronics mentioned above. Furthermore, the earphone also provides a better sound transmission for the listener so that the listener can clearly hear and understand the content of the sound.

The existing earphones can be divided into in-ear earphone, headphone and half-in-ear earphone according to different wearing styles, and mainly comprise an earphone front housing, an earphone rear housing and a loudspeaker unit (a horn) accommodated in the earphone front housing and the rear housing. As different users for earphones have different preferences for the frequency response of the earphone, and for different operating environment, the earphones are required to be adjusted to different frequency response based on individual demands, thus there is an urgent need for an earphone capable of adjusting the frequency response of the earphone based on individual demand so as to adapt to different users and environments.

SUMMARY

In view of the above problems, an object of the present application is to provide an earphone, so as to solve the problem that the same type of earphone cannot meet the user's different requirements on the low frequency of the earphone at present.

The present application provides an earphone which comprising an earphone housing and a loudspeaker unit accommodated in the earphone housing, the loudspeaker unit dividing a cavity formed by the earphone housing into an earphone front sound cavity and an earphone rear sound cavity; wherein the earphone further comprises a tuning mechanism; wherein a rear sound cavity audio hole is provided on a loudspeaker unit rear sound cavity, and the loudspeaker unit rear sound cavity is in communication with the earphone rear sound cavity through the rear sound cavity audio hole; and the tuning mechanism is provided between the rear sound cavity audio hole and the housing, and the tuning mechanism is used to adjust the size of the rear sound cavity audio hole of the loudspeaker unit.

In addition, the preferred structure is that the earphone housing comprises an earphone front housing and an earphone rear housing which is adaptively connected to the earphone front housing; and the earphone front sound cavity is formed by the earphone front housing and the loudspeaker unit, and the earphone rear sound cavity is formed by the earphone rear housing and the loudspeaker unit.

In addition, the preferred structure is that the loudspeaker unit comprises a unit housing and a vibration system and a magnetic circuit system accommodated in the unit housing; the magnetic circuit system comprises a magnetic conductive yoke, a magnet located at a center of the magnetic conductive yoke, a washer located at a side of the magnet away from the magnetic conductive yoke; and the vibration system comprises a vibrating diaphragm, a voice coil fixed at one side of the vibrating diaphragm, and a reinforcing part located at a center of the vibrating diaphragm.

In addition, the preferred structure is that through-holes, positions of which are corresponding to each other, are respectively disposed on the magnetic conductive yoke, the magnet and the washer, and the loudspeaker unit rear sound cavity is in communication with the earphone rear sound cavity through the through-holes In addition, the preferred structure is that the tuning mechanism comprises a tuning unit, a tuning knob and a connecting rod; the tuning unit is disposed in the through-hole of the magnetic conductive yoke, the tuning knob is adaptively connected to the tuning unit, and the connecting rod is fixed between the earphone housing and the tuning knob.

In addition, the preferred structure is that a groove/protrusion is provided at one end of the connecting rod, the tuning knob is provided with a protrusion/groove corresponding to the groove/protrusion, the protrusion is locked into the groove; and the connecting rod is used for rotating the tuning knob and adjusting a relative position between the tuning knob and the tuning unit.

In addition, the preferred structure is that the tuning unit is a disk provided with an arc-shaped tuning hole, and the tuning knob is a semi-circular disk rotatable around a center of the tuning unit; and the tuning knob is rotated on the tuning unit to adjust a degree of covering the arc-shaped tuning hole.

In addition, the preferred structure is that a tuning network, a radian of which is consistent with a radian of the arc-shaped tuning hole, is attached to the arc-shaped tuning hole.

In addition, the preferred structure is that the earphone further comprises an ear rubber sleeve; and the ear rubber sleeve is sleeved on the main sound output tube of the earphone front housing.

In addition, the preferred structure is that the earphone further comprises an earphone wire; one end of the earphone wire is electrically connected to the loudspeaker unit, and the other end of the earphone wire is provided with an earphone plug.

It can be seen from the above technical solutions that the earphone provided by the present application can adjust the volume of air through the sounding hole of the loudspeaker unit rear sound cavity by controlling the size of the communication hole between the loudspeaker unit rear sound cavity and the earphone rear sound cavity through the tuning mechanism, so as to achieve the purpose of adjustable sound quality of the earphone. The earphone provided by the present application has the advantages of simple structure and wide application range.

BRIEF DESCRIPTION OF THE DRAWINGS

By referring to the descriptions of the accompanying drawings and the claims, and with a full understanding of the present application, other purposes and results of the present application will be more clearly and easily understand. In the drawings:

Figure 1:
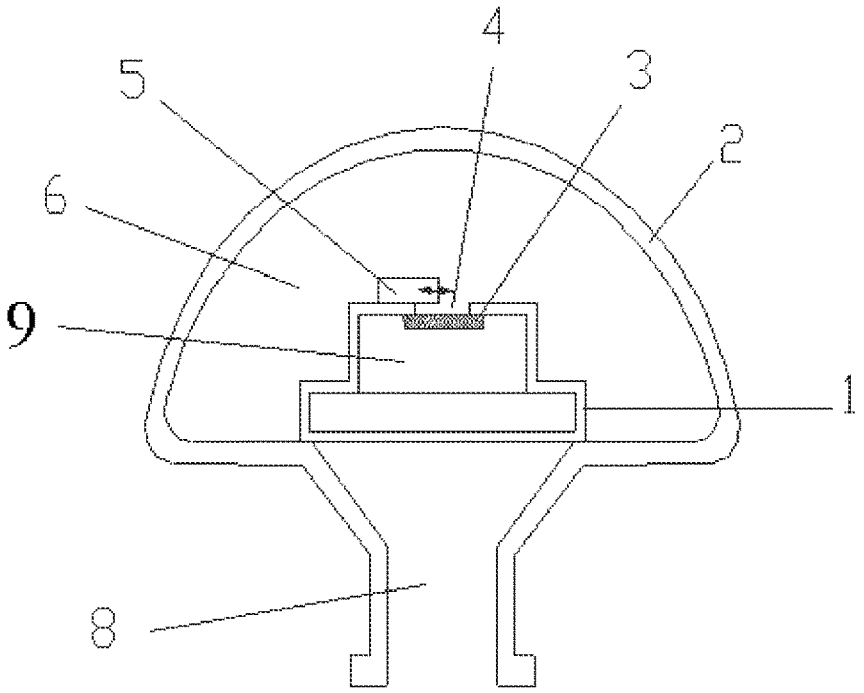
FIG. 1 is a schematic diagram of the earphone according to an embodiment of the present application.

Wherein, the reference numerals comprise: loudspeaker unit 1, vibrating diaphragm 11, washer 12, voice coil 13, magnet 14, magnetic conductive yoke 15, earphone housing 2, earphone rear housing 21, earphone front housing 22, tuning network 3, tuning hole 4, tuning mechanism 5, connecting rod 51, rotary head 511, groove 512, tuning knob 52, protrusion 521, tuning network 53, tuning unit 54, tuning hole 541, earphone rear sound cavity 6, ear rubber sleeve 7, earphone front sound cavity 8 and loudspeaker unit rear sound cavity 9.

Similar signs in all figures indicate similar or corresponding features or functions.

DETAILED DESCRIPTION OF EMBODIMENTS

In order to describe the structure of the earphone of the present application in detail, particular embodiments of the present application will be described in detail below with reference to the accompanying drawings.

FIG. 1 shows a schematic diagram of the earphone according to an embodiment of the present application.

As shown in FIG. 1, the earphone according to an embodiment of the present application comprises an earphone housing 2, a loudspeaker unit 1 (a sounding unit) accommodated in the earphone housing 2, and a tuning mechanism 5. A cavity formed by the earphone housing 2 is divided into an earphone front sound cavity 8 and an earphone rear sound cavity 6 by the loudspeaker unit 1. Wherein, a rear sound cavity audio hole (i.e., a rear tuning hole 4) is provided on the loudspeaker unit 1, the loudspeaker unit rear sound cavity 9 is in communication with the earphone rear sound cavity 6 through the rear tuning hole 4, and a corresponding tuning network 3 is attached to the rear tuning hole 4; the tuning mechanism 5 is disposed between the rear tuning hole 4 and the earphone housing 2 for adjusting the air volume of the rear sound cavity audio hole so as to adjust the frequency response of the earphone. Wherein, only in the process of describing the above principle, the tuning hole 4 and the rear sound cavity audio hole of the loudspeaker unit 1 have the same structure.

The tuning mechanism and its fixing method in the earphone of the present application will be described in detail with reference to particular embodiments below.

Figure 2:
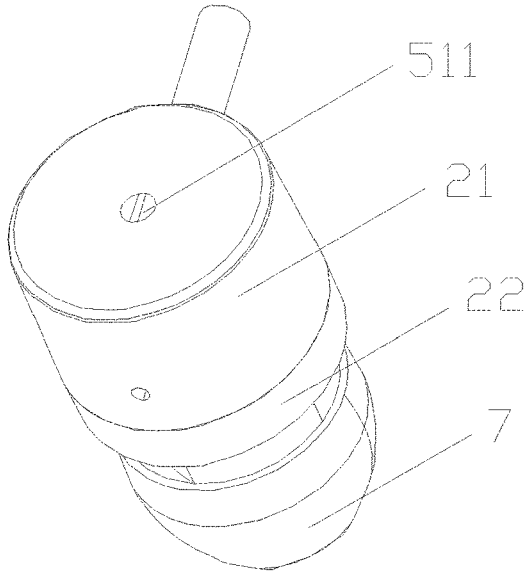
FIG. 2 is a schematic structural view of the earphone according to an embodiment of the present application.
Figure 3:
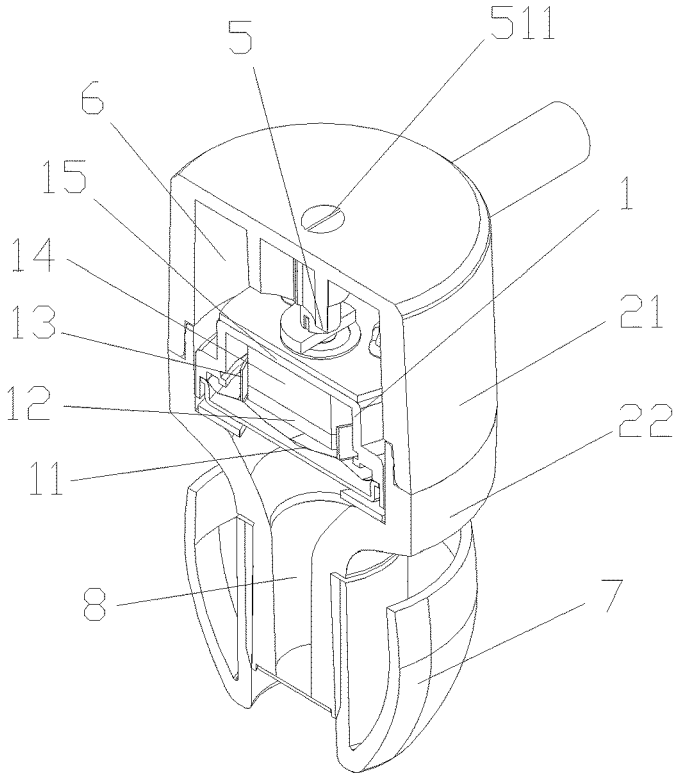
FIG. 3 is a schematic cross-sectional structural view of the earphone according to an embodiment of the present application.

FIG. 2 shows the mechanism of the earphone according to an embodiment of the present application; and FIG. 3 shows the cross-sectional structure of the earphone according to an embodiment of the present application.

As shown in FIG. 2 and FIG. 3, the earphone of the embodiment of the present application comprises an earphone front housing 22, an earphone rear housing 21 adaptively connected to the earphone front housing 22, a loudspeaker unit 1 accommodated in the earphone front housing 22 and the earphone rear housing 21, and a tuning mechanism 5; wherein a cavity formed between the loudspeaker unit 1 and the earphone front housing 22 is a earphone front sound cavity 8, and a cavity formed between the loudspeaker unit 1 and the earphone rear housing 21 is earphone rear sound cavity 6. The earphone rear sound cavity 6 and the loudspeaker unit rear sound cavity are communicated through the rear sound cavity audio hole of the loudspeaker unit 1. The tuning mechanism 5 is disposed between the rear sound cavity audio hole and the earphone housing (comprising the earphone front housing 22 and the earphone rear housing 21) for adjusting the size of the rear sound cavity audio hole of the loudspeaker unit.

Specifically, in one embodiment of the present application, the loudspeaker unit 1 comprises a unit housing, a vibration system and a magnetic circuit system accommodated in the unit housing. The magnetic circuit system comprises a magnetic conductive yoke 15 for fixing the magnet 14 and correcting magnetic lines of force, a magnet 14 disposed at a center of the magnetic conductive yoke 15, a washer 12 located at a side of the magnet 14 away from the magnetic conductive yoke 15, wherein magnetic gaps are formed between the magnet 14 and the sidewall of the magnetic conductive yoke 15, and between and the washer 12 and the sidewall of the magnetic conductive yoke 15, and the voice coil 13 is suspended in the magnetic gaps. The magnetic conductive yoke 15 is fixed to the unit housing, and the vibration system, the magnet 14, and the washer 12 are accommodated in a cavity formed by the magnetic conductive yoke 15 and the unit housing. The washer 12, the magnet 14 and the magnetic conductive yoke 15 are fixedly connected to each other from above to below.

The vibration system comprises a vibrating diaphragm 11, a voice coil 13 fixed at one side of the vibrating diaphragm 11, and a reinforcing part located at a center of the vibrating diaphragm 11. Wherein, the vibrating diaphragm 11 comprises a fixing part (located at an outermost periphery of the vibrating diaphragm) fixedly connected to the unit housing, a bending annular part with a concave/convex structure integrally provided with the fixing part, and a plane part (located at an innermost part of the vibrating diaphragm) provided inside the bending annular part. The reinforcing part is provided on the plane part of the vibrating diaphragm 11, and mainly used for adjusting the acoustic performance of the speaker. In order to reduce the overall weight of the vibration system, the material is removed at a position on the plane part of the vibrating diaphragm corresponding to the reinforcing part, and the reinforcing part covers the position where the material is removed.

The space formed by the unit housing is divided into a loudspeaker unit front acoustic cavity and a loudspeaker unit rear sound cavity by the vibrating diaphragm 11. In the present application, in order to connect the loudspeaker unit rear sound cavity and the earphone rear sound cavity 6, corresponding through-holes are respectively disposed at central positions of the magnetic conductive yoke 15, the magnet 14 and the washer 12 of the loudspeaker unit, and the respective positions of the through-holes are aligned, thereby constituting a hole penetrating the entire magnetic circuit system. The loudspeaker unit rear sound cavity is in communication with the earphone rear sound cavity 6 through the respective through-holes. A tuning mechanism 5 (comprising a rotary head 511) for controlling the size of the communication hole between the loudspeaker unit rear sound cavity and the earphone rear sound cavity 6 is provided between the magnetic conductive yoke 15 and the earphone housing of the loudspeaker unit 1.

Wherein, the communication hole between the loudspeaker unit rear sound cavity and the earphone rear sound cavity is the rear sound cavity audio hole of the loudspeaker unit. When the tuning mechanism is disposed on the rear sound cavity audio hole, the communication hole is the remaining part of rear sound cavity audio hole covered by the tuning mechanism. In other words, when the size of the rear sound cavity audio hole of the loudspeaker unit is adjusted by the tuning mechanism, the communication hole between the loudspeaker unit rear sound cavity and the earphone rear sound cavity is a partial rear sound cavity audio hole uncovered by the tuning mechanism 5.

Figure 4:
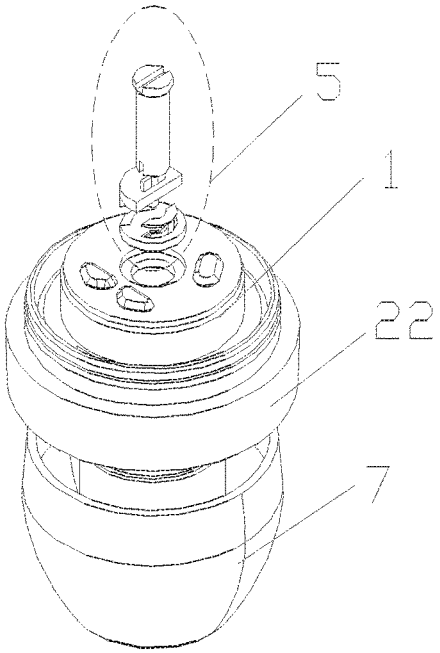
FIG. 4 is a schematic diagram of a part of the structure of an earphone according to an embodiment of the present application.
Figure 5:
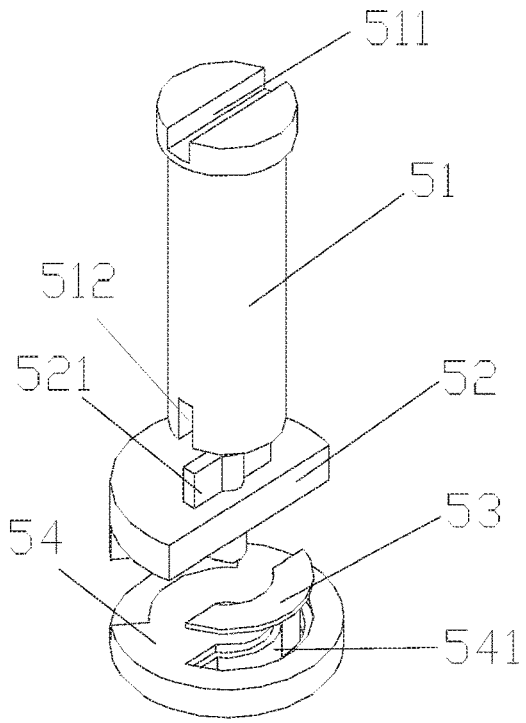
FIG. 5 is a schematic exploded view of a tuning mechanism according to an embodiment of the present application.

Specifically, FIG. 4 shows a partial structure of an earphone according to an embodiment of the present application, and FIG. 5 is an exploded view showing the structure of the tuning mechanism according to an embodiment of the present application.

As shown in FIG. 4 and FIG. 5, the tuning mechanism 5 of the embodiment of the present application comprises a tuning unit 54, a tuning knob 52 and a connecting rod 51. The tuning unit 54 is disposed in the through-hole of the magnetic conductive yoke, and covers the rear sound cavity audio hole. The tuning knob 52 is fixed at one side of the tuning unit 54 away from the magnetic conductive yoke, and is adaptively connected and fixed to the tuning unit 54. The connecting rod 51 is fixed between the earphone housing and the tuning knob 52. After the earphone is entirely assembled, a user can control the relative position between the tuning knob 52 and the tuning unit 54 inside the earphone housing by rotating the connecting rod 51 so as to adjust the middle and low frequency response of the loudspeaker unit 1, thereby adjusting the overall sound quality of the earphone.

Wherein, the tuning unit 54 is of a disk-shaped structure. A tuning hole 541 with an arc structure is disposed on the tuning unit 54. The tuning knob 52 is of a semi-circular disk structure capable of rotating around a center of the tuning unit 54. The tuning knob 52 is rotated on the tuning unit 54 and covers different areas of the tuning holes 541 so as to adjust the size of the communication hole between the loudspeaker unit rear sound cavity and the earphone rear sound cavity, thereby adjusting the effect of the low frequency response of the earphone. Wherein, in order to simplify the connection between the tuning knob 52 and the tuning unit 54, a raised cylinder may be provided at a center of the tuning knob 52, and a cylindrical recess is disposed on the tuning unit 54 corresponding to the position of the raised cylinder, so that the raised cylinder of the tuning knob 52 may be inserted into the corresponding recess of the tuning unit 54 so as to enable the tuning knob 52 to rotate in the tuning unit 54.

Figure 6:
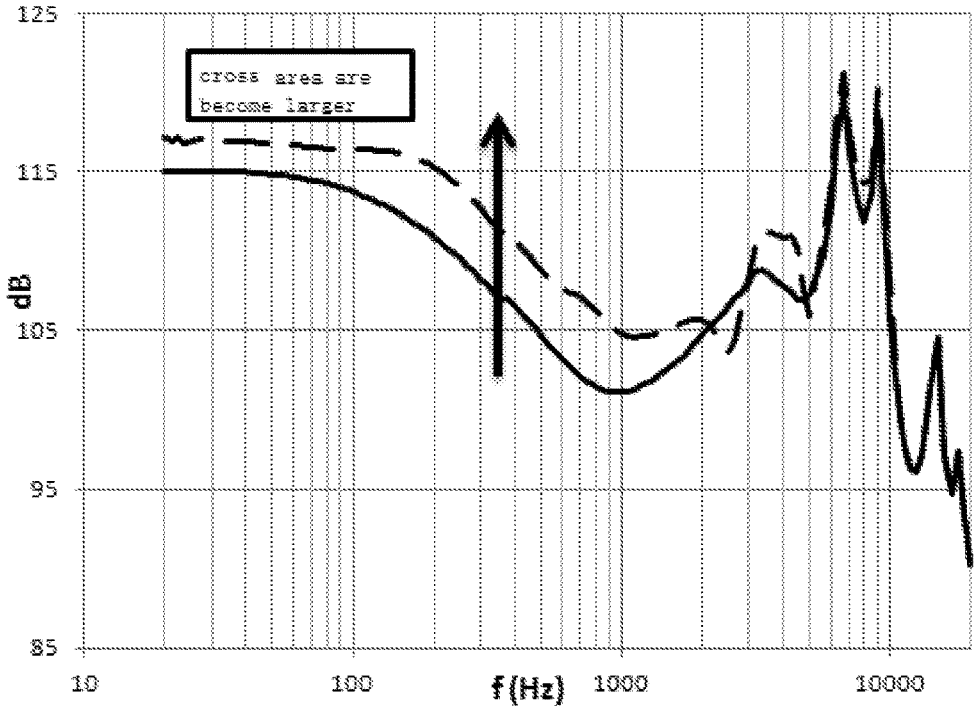
FIG. 6 is a graph showing the frequency response of an earphone according to an embodiment of the present application.

As for the above operation for adjusting the middle and low frequency response of the earphone by controlling the size of the sounding hole of the loudspeaker unit rear sound cavity through the tuning mechanism, FIG. 6 shows a comparison result of the frequency response curves of the earphone before and after adjusting the sounding hole of the loudspeaker unit rear sound cavity according to the embodiment of the present application.

As shown in FIG. 6, the horizontal axis shows the frequency (Hz), the vertical axis shows the frequency response (dB); and the solid line shows the frequency response curve of the earphone when the tuning mechanism is rotated to make the cross-sectional area of the sounding hole of the loudspeaker unit rear sound cavity smaller (the sounding hole of the loudspeaker unit rear sound cavity is smaller) and the dotted line shows the frequency response curve of the earphone when the tuning mechanism is rotated to make the cross-sectional area of the sounding hole of the loudspeaker unit rear sound cavity larger. It can be seen that when the tuning mechanism is rotated to different positions, an area of the sounding hole of the loudspeaker unit rear sound cavity is changed, that is, the volume of air between the earphone rear sound cavity and the loudspeaker unit rear sound cavity will be changed, which leads to different middle and low frequency responses of the earphone. Moreover, when the volume of air between the earphone rear sound cavity and the loudspeaker unit rear sound cavity becomes larger, the middle and low frequency response of the earphone is obviously higher than the frequency response when the volume of air therebetween is smaller. Therefore, the tuning mechanism can be rotated to change the area of the sounding hole of the loudspeaker unit rear sound cavity, so as to change the frequency response curve of the middle and low frequency responses of the earphone to change the overall sound quality of the earphone.

In one particular embodiment of the present application, one end of the connecting rod 51 is provided with a groove/protrusion 512, and a protrusion/groove 521 corresponding to the groove/protrusion 512 of the connecting rod 51 is provided on the tuning knob 52. The connecting rod 51 is movably connected to the tuning knob 52 by locking the protrusion 521 on the tuning knob 52 (or the protrusion on the connecting rod) into the corresponding groove 512 of the connecting rod 51 (or the groove in the tuning knob). The other end of the connecting rod 51 is provided with a rotary head 511 for conveniently rotating the connecting rod 51, and the rotary head 511 is embedded in the earphone housing. When the user uses the earphone, the low frequency sound quality of the earphone can be adjusted by rotating the rotary head 511 located on back of the earphone housing, and the operation is convenient and simple.

It should be noted that the tuning knob 52 is not limited to a semicircular structure, and a radian of the tuning hole 541 and a radian of the arc-shaped tuning hole 541 located on the tuning unit 54 can be set according to customer requirements. Preferably, the radian of the tuning hole 541 is 180°, corresponding to the semicircular tuning knob 52. In addition, the connections between the connecting rod and the tuning knob, the tuning knob and the tuning unit are not limited to the above-mentioned arrangement of the protrusions or the grooves, and any arrangement or connection type is possible, as long as the tuning knob is driven to rotate on the tuning unit by rotating the connecting rod and the tuning holes on the tuning unit are covered in different degrees.

In order to ensure the sound production effect and sound quality of the loudspeaker unit, in another embodiment of the present application, a tuning network 53 or a damping net, the radian of which is consistent with the radian of the arc-shaped tuning hole 541, is attached to the arc-shaped tuning hole 541. The tuning network 53 is provided to not only block contaminants such as small particles in the earphone housing from entering the interior of the loudspeaker unit 1, but also to adjust the acoustic performance of the loudspeaker unit.

In addition, the earphone of the embodiment of the present application further comprises an ear rubber sleeve 7 and an earphone wire, wherein the ear rubber sleeve 7 is sleeved on a main sound output tube of the earphone front housing 22, and may be made from materials such as silica gel or high-elasticity polyester, which can come into close contact with the auditory meatus after inserted into the auditory meatus, so as to isolate the sound from entering the middle ear and the inner ear to achieve sound insulation. One end of the earphone wire is electrically connected to the loudspeaker unit, and the other end of the earphone wire is provided with an earphone plug for cooperating with external portable electronics.

In addition, it should be noted that in another structure of the tuning mechanism in the present application, there may be a plurality of tuning holes for communicating the loudspeaker unit rear sound cavity and the earphone rear sound cavity, a rotary cover is disposed outside the tuning hole, and a plurality of stoppers and rotary cover handles are disposed on the rotary cover. By rotating the rotary cover outside the tuning hole, and changing the number of the tuning holes of the loudspeaker unit rear sound cavity, the volume of air between the loudspeaker unit and the earphone housing may be controlled, so as to adjust the sound quality of the earphone. Because the principle is similar, the specific implementation of the structure will not be repeated herein.

It can be seen from the above embodiments that in the earphone provided by the present application, the tuning holes on the tuning unit are covered by the tuning knob in different degrees, by rotating the tuning knob via the rotation of the connecting rod, thereby controlling the air volume of the tuning hole between the loudspeaker unit rear sound cavity and the earphone rear sound cavity, to achieve the purpose of changing the frequency response of the earphone. The advantages are that the structure is simple, the operation is convenient, and the user experience is improved.

As described above, the earphone provided by the present application is described by way of example with reference to the accompanying drawings. However, it should be understood by those skilled in the art that various improvements can be made to the earphone provided by the present application as described above without departing from the contents of the present application. Accordingly, the scope of protection of the present application is determined by the contents of the appended claims.

The invention claimed is:

1. An earphone, comprising an earphone housing and a loudspeaker unit accommodated in the earphone housing, the loudspeaker unit dividing a cavity formed by the earphone housing into an earphone front sound cavity and an earphone rear sound cavity, wherein the earphone further comprises a tuning mechanism;

wherein a rear sound cavity audio hole is provided on a loudspeaker unit rear sound cavity, and the loudspeaker unit rear sound cavity is in communication with the earphone rear sound cavity through the rear sound cavity audio hole;

wherein the tuning mechanism is provided between the rear sound cavity audio hole and the earphone housing, and the tuning mechanism is used to adjust a size of the rear sound cavity audio hole of the loudspeaker unit;

wherein the loudspeaker unit comprises a unit housing and a vibration system and a magnetic circuit system accommodated in the unit housing;

the magnetic circuit system comprises a magnetic conductive yoke, a magnet located at a center of the magnetic conductive yoke, and a washer located at a side of the magnet away from the magnetic conductive yoke;

through-holes, positions of which correspond to each other, are respectively disposed on the magnetic conductive yoke, the magnet and the washer, and the loudspeaker unit rear sound cavity is in communication with the earphone rear sound cavity through the through-holes;

the tuning mechanism comprises a tuning unit, a tuning knob and a connecting rod; and the tuning unit is disposed in the through-hole of the magnetic conductive yoke, the tuning knob is adaptively connected to the tuning unit, and the connecting rod is fixed between the earphone housing and the tuning knob.

2. The earphone according to claim 1, wherein the earphone housing comprises an earphone front housing and an earphone rear housing which is adaptively connected to the earphone front housing; and wherein the earphone front sound cavity is formed by the earphone front housing and the loudspeaker unit, and the earphone rear sound cavity is formed by the earphone rear housing and the loudspeaker unit.

3. The earphone according to claim 2, wherein the vibration system comprises a vibrating diaphragm, a voice coil fixed at one side of the vibrating diaphragm, and a reinforcing part located at a center of the vibrating diaphragm.

4. The earphone according to claim 1, wherein a groove/protrusion is provided at one end of the connecting rod, the tuning knob is provided with a protrusion/groove corresponding to the groove/protrusion, the protrusion is locked in the groove; and wherein the connecting rod is used for rotating the tuning knob and adjusting a relative position between the tuning knob and the tuning unit.

5. The earphone according to claim 1, wherein the tuning unit is a disk provided with an arc-shaped tuning hole, and the tuning knob is a semi-circular disk rotatable around a center of the tuning unit; and wherein the tuning knob is rotated on the tuning unit to adjust a degree of covering the arc-shaped tuning hole.

6. The earphone according to claim 5, wherein a tuning network, a radian of which is in consistent with a radian of the arc-shaped tuning hole, is attached to the arc-shaped tuning hole.

7. The earphone according to claim 1, further comprising an ear rubber sleeve; and wherein the ear rubber sleeve is sleeved on a main sound output tube of the earphone front housing.

8. The earphone according to claim 1, further comprising an earphone wire; and wherein one end of the earphone wire is electrically connected to the loudspeaker unit, and the other end of the earphone wire is provided with an earphone plug.

* * * * *